US006471402B1

(12) United States Patent
Burns

(10) Patent No.: US 6,471,402 B1
(45) Date of Patent: Oct. 29, 2002

(54) FORMED STACKING ELEMENT INTEGRAL WITH PLASTIC STORAGE BAGS

(76) Inventor: Jeff Burns, 403 Vicky La., Alexandria, LA (US) 71303

( * ) Notice: Subject to any disclaimer, the term of this patent is extended or adjusted under 35 U.S.C. 154(b) by 0 days.

(21) Appl. No.: 10/006,841

(22) Filed: Nov. 5, 2001

(51) Int. Cl.[7] ..... B65D 33/02
(52) U.S. Cl. ..... 383/32; 383/119; 206/509
(58) Field of Search ..... 383/32, 119; 206/509

(56) References Cited

U.S. PATENT DOCUMENTS

| | | | |
|---|---|---|---|
| 1,710,386 | A | 4/1929 | Taylor |
| 1,896,601 | A | 2/1933 | Andrews |
| 2,331,966 | A | 10/1943 | Eisgrau |
| 2,643,048 | A | 6/1953 | Wilson |
| 2,673,768 | A | 5/1954 | Vergobbi |
| 3,283,992 | A | 11/1966 | Hanson et al. |
| 3,396,901 | A | 8/1968 | McFedries, Jr. |
| 5,028,147 | A | 7/1991 | Graham |
| 5,094,547 | A | 3/1992 | Graham |
| 5,520,010 | A | 5/1996 | Altman |
| 5,735,423 | A | 4/1998 | Black |
| 5,762,260 | A | 6/1998 | Goglio |

*Primary Examiner*—Philippe Derakshani
(74) *Attorney, Agent, or Firm*—Michael I Kroll

(57) ABSTRACT

The present invention 10 discloses stackable bag containers 12 having opposing mating rigid planar elements 14, 15 disposed on the interior of the bags contiguous to the walls of the bag 12 having impressed therein interlocking curvilinear grooves 16, 17 extending across the rigid element 14, 15 and terminating spaced away from the periphery edge 20 of the rigid planar element 14, 15. Bag locking device 26 are provided. Embodiments utilizing corrugated walls 30, circular indentions 32 and cross line indentions are also disclosed along with an embodiment providing a sanitary storage bag for use with a conventional flowable product dispenser.

15 Claims, 19 Drawing Sheets

FORMED STACKING ELEMENT INTEGRAL WITH PLASTIC STORAGE BAGS

BACKGROUND OF THE INVENTION

1. Field of the Invention

The present invention relates generally to stackable containers and, more specifically, to a plastic bag having opposing mating rigid planar elements having impressed therein interlocking curvilinear grooves extending across said rigid element and terminating spaced away from the periphery edge of said rigid planar element.

2. Description of the Prior Art

There are other stackable elements designed for plastic bags. Typical of these is U.S. Pat. No. 1,710,386 issued to Taylor on Apr. 9, 1928.

Another patent was issued to Andrews on Feb. 7, 1933 as U.S. Pat. No. 1,896,601. Yet another U.S. Pat. No. 2,331,966 was issued to Eisgrau on Oct. 19, 1943 and still yet another was issued on Jun. 23, 1953 to Wilson as U.S. Pat. No. 2,643,048.

Another patent was issued to Vergobbi on May 18, 1954 as U.S. Pat. No. 2,678,768. Yet another U.S. Pat. No. 3,283,992 was issued to Hanson et al on Nov. 8, 1966. Another was issued to McFedries Jr. on Jan. 30, 1967 as U.S. Pat. No. 3,396,901 and still yet another was issued on Jul. 2, 1991 to Graham as U.S. Pat. No. 5,028,147.

Another patent was issued to Graham on Mar. 10, 1992 as U.S. Pat. No. 5,094,547. Yet another U.S. Pat. No. 5,520,010 was issued to Altman on May 28, 1996. Another was issued to Black on Apr. 7, 1998 as U.S. Pat. No. 5,735,423 and still yet another was issued on Jun. 9, 1998 to Goglio as U.S. Pat. No. 5,762,260.

U.S. Pat. No. 1,710,386

Inventor: H. F. Taylor

Issued: Apr. 23, 1929

The invention discloses a method for wrapping comestibles, such as fillets of fish, cuts of meat, dressed fish and the like in either their fresh or frozen state. The package prevents escape of liquids. The package is comprised of a rigid waterproof material and a waterproof wrapper enveloping said comestible and support.

U.S. Pat. No. 1,896,601

Inventor: O. B. Andrews

Issued: Feb. 7, 1933

The invention discloses a band for packing a loaf of sliced bread comprising a strip of flexible box board having a plurality of slots at one end thereof spaced to provide tongues therebetween, and a plurality of notches at the other end thereof adapted to adjustably engage said tongues, said band having perforations between said notches whereby the outer section may be torn off when not in use.

U.S. Pat. No. 2,331,966

Inventor: L. Eisgrau

Issued: Oct. 19, 1943

The invention discloses a type of folded paper bag that is reinforced so that it acts like a box when opened up. The bag is a bellows type of bag and two stiffening inserts within the bag attached to portions of the bellows one on each side of the bag, each insert being substantially as wide as the bellows when extended, each insert ends substantially one-half said width from the bottom edge of the bag when said bag is collapsed, the portions of the inserts at the other ends being bendable inwardly equal distances from the bottom of the bag, one of said last mentioned portions being substantially as long as the bag is wide when opened.

U.S. Pat. No. 2,643,048

Inventor: I. V. Wilson

Issued: Jun. 23, 1953

Containers fabricated from cellulosic material characterized by a slip resistant surface and having side walls and a top and bottom closure composed of an outer paper layer, said container having a discontinuous film of discrete particles of colloidal silica on the outer surface of said outer paper layer, said silica being present in amounts of 0.01 to 5% based on the weight of the outer paper layer.

U.S. Pat. No. 2,678,768

Inventor: Robert W. Vergobbi

Issued: May 18, 1954

The novel packaging is a reinforced bag comprising a bag of flexible, transparent material and a reinforcing structure within the bottom portion of the bag, said reinforcing structure comprising a bottom panel disposed within the bag and composed of a material substantially stiffer than the bag material and being adhesively secured to the bottom of the bag, said bottom panel having rounded corners and two integral side panels provided with relatively short, laterally extended flaps adjacent the lower portions of the side walls and curved to conform to the rounded corners of the bottom portion of the reinforcement, said integral side panels extending upwardly for a portion of the height of the bag along two opposed side walls, said side panels being substantially narrower than the side walls of the bag to which they are adjacent to permit the longitudinal corners of the bag to assume a rounded form corresponding to the rounded corners of the bottom panel when the bag is filled.

U.S. Pat. No. 3,283,992

Inventor: L. A. Hanson et al.

Issued: Nov. 8, 1966

The bag of the present invention is fabricated from a thin plastic film and having opposed top and bottom walls joined by side walls, the improvement which comprises a plurality of spaced apart first ridges formed in and constituting a part of each of said top and bottom walls of said bag, said first ridges opening inwardly of said bag, and a plurality of spaced-apart second ridges formed in and constituting a part of each of said top and bottom walls of said bag, said second ridges opening outwardly of said bag, said first and second ridges extending in at least two different directions in both said top and bottom walls of said bag, said ridges being adapted to interlock with and overlap similar ridges formed in another bag when said bags are in stacked relationship to resist sliding of said bags relative to each other.

U.S. Pat. No. 3,396,901

Inventor: R. McFedries, Jr.

Issued: Aug. 13, 1968

A synthetic, resinous package comprising at least a first panel and a second panel, the first and second panels being disposed in facing relationship, the first and second panels being joined in regions at least about three edge portions, the first and second panels defining inner faces and outer faces, the inner faces of the first and second panels comprising a non-blocking polyolefin resin selected from the group consisting of ethylene polymers, propylene polymers, and resinous copolymers of ethylene and propylene, the second or outer faces of the panels comprising a chlorinated olefin polymer having a slip angle of at least 50%, the slip angle being determined by stretching a sheet of material to be evaluated on a flat surface, securing the material to the surface, overwrapping a block weighing one pound and having a rectangular face measuring 2×2 inches with another portion of the material to be tested, placing the covered 2×2 inch surface of the block in engagement with a portion of the film secured to the flat surface subsequently raising one end of the flat surface to cause the surface of the block to assume an increase in angle of the flat surface to the horizontal when the block commences to slide or move.

U.S. Pat. No. 5,028,147

Inventor U.S. Pat. No. : 5,028,147

Issued: Jul. 2, 1991

The invention is an integrated container structure in which a sealable envelope of flexible material such as plastic, has disposed within it a carton of semi-rigid material which is bonded to the interior of the envelope at one or more places. The carton consists of a sheet of carton material having appropriate fold lines and configuration to be erected or collapsed into a generally flat structure within the envelope. The invention is particularly useful for the shipment of animal products containing bones and has the advantages that it can be stored in a flat configuration and easily erected into an upright carton within the envelope by simple manipulative procedures.

U.S. Pat. No. 5,094,547

Inventor: Mark S. Graham

Issued: Mar. 10, 1992

The invention is an integrated container structure in which a sealable envelope of flexible material such as plastic, has disposed within it a carton of semi-rigid material which is bonded to the interior of the envelope at one or more places. The carton consists of a sheet of carton material having appropriate fold lines and configuration to be erected or collapsed into a generally flat structure within the envelope. The invention is particularly useful for the shipment of animal products containing bones and has the advantages that it can be stored in a flat configuration and easily erected into an upright carton within the envelope by simple manipulative procedures.

U.S. Pat. No. 5,520,010

Inventor: Francis M. Altman

Issued: May 28, 1996

Apparatus for forming substantially parallel upper and lower surfaces on flexible freezer bags containing freezable materials so that upon freezing the packages are readily stackable one above another. The apparatus includes a rigid base plate having a planar top surface, a plurality of substantially parallel, spaced column members extending upwardly from the top surface of the base plate, and a plurality of rigid, intermediate plate members adapted to be slidably carried along the surfaces of the column members so that the upper and lower surfaces of the intermediate plate members are substantially parallel with the planar top surface of the base plate. Bags having fluid or semi-solid, flexible contents to be frozen are positioned one above another between respective intermediate plate members for freezing. After freezing the bags have opposed, parallel upper and lower surfaces that facilitate stacking the bags on a horizontal freezer shelf.

U.S. Pat. No. 5,735,423

Inventor: William S. Black

Issued: Apr. 7, 1998

A foldable, self-standing container is disclosed which can be formed of plastic, paper, metal, or other materials and can be sealed with an integral top. The container is formed with unique fold lines in two side sections and the bottom section. When folded, the self-standing container lies flat and can be instantly opened into the upright, self-standing position by exerting opposing forces on two exposed sides of the container. When formed of metal, the fold lines are made in the form of joints, preferably connected with a resilient, liquid-tight, heatproof sealant material. Also disclosed is an efficient method for bulk dispensing of the containers as well as a method of making and folding the containers, including an inventive box folding device.

U.S. Pat. No. 5,762,260

Inventor: Luigi Goglio

Issued: Jun. 9, 1998

A container is made of flexible sheet material, particularly for products with a solid consistency, obtained by successive folding and sealing of a sheet material. It is substantially parallelepiped-shaped. The container (1) has, at two of its opposite facing side walls (16), respective reinforcing plates (7) and is provided with a bottom seal (4), subsequently folded and sealed on the bottom (8) of the container, to strengthen it, a system for opening by means of a pull tab (6) being provided at the top of the container.

While these plastic bags may be suitable for the purposes for which they were designed, they would not be as suitable for the purposes of the present invention, as hereinafter described.

SUMMARY OF THE PRESENT INVENTION

The present invention discloses stackable bag containers having opposing mating rigid planar elements disposed on the interior of the bags contiguous to the walls of the bag having impressed therein interlocking curvilinear grooves extending across the rigid element and terminating spaced away from the periphery edge of the rigid planar element. Bag locking means are provided. Embodiments utilizing corrugated walls, circular indentions and cross line indentions are also disclosed along with an embodiment providing a sanitary storage bag for use with a flowable product dispenser.

While there are plastic bags having interlocking elements, they do not provide substantial interlocking elements as in the present invention where placement of one plastic bag over another with the grooves in close proximity to one another would cause the grooves of the upper bag to seat within the grooves of the lower bag because the grooves are substantially rounded at each distal end.

Furthermore, the rigid planar elements having straight edges perpendicular to one another can be stood on any side with the grooves preventing movement between the bag. The rigid planar element will also add strength and will provide a controlled means for storing goods.

This product relates to the general storage, packaging, freezing, and heating of materials used in homes, restaurants, hospitals, manufacturing, and other businesses. More specifically, this product relates to plastic bags and containers used for storage of materials. This new system can be used to substantially improve the structure of the plastic bag and create a more efficient and effective means of storing materials. This new innovation is called Stack Lock™ Brand Bags.

Resealable, plastic bags and containers have become one of the most popular methods used for storing materials. Today, busy, price-conscience consumers have readily embraced plastic bags and containers as an effective and efficient manner to store materials. These types of storage products are replacing cardboard, waxed paper, aluminum foil, and standard plastic bags as the preferred product. Consumers of these storage products find the ability to reseal these bags and containers with "Zippers" or "slide-locks" that make it easy to ensure freshness by creating a tight and secure seal. These products have been able to provide an easy-to-use, and easy-to-dispose-of method of storing material.

Ziploc™ Brand plastic bags and containers are the most popular brand in this product market. Ziploc™ offers a variety of methods for resealing their plastic bags and containers as well as a variety of sizes. Their plastic bag products come in a variety of sizes. Their plastic bag products come in a variety of sizes ranging from sandwich size to bags able to hold two gallons. These bags come packaged in several different amounts ranging from 15 to 100 bags depending on the size and use of the bags. The plastic containers are offered in packages containing 4 to 8 containers that can hold 1 to 9.5 cups of material.

Both of these products have limitations and problems. The plastic bags are not rigid enough to maintain a uniform shape and become impossible to store or stack neatly especially when liquids are involved. Because the bags lack this rigidity, they also tend to provide little protection against impacts and cannot bear any weight without losing its shape. Although the plastic containers provide a solid structure that maintains a consistent shape, which can be stored neatly, the containers are bulky and cannot be packaged efficiently. The consumer can purchase only a few at a time and the size of the package makes it difficult for the consumer to store before they use the container. The plastic containers are more costly to produce and package; therefore, the consumer may pay up to 200% more per unit versus the cheaper plastic bags.

Stack Lock™ Brand plastic bags provide the best benefits from both the plastic bag and containers. Stack Lock™ bags are not as costly as the plastic containers and can be easily stored and packaged in larger quantities while providing the stability of the plastic containers when filled with material. Adding rigid plates impressed with interlocking grooves with male and female or convex/concave profiles accomplishes this. These grooves are extruded, injected, and/or attached to a resealable, heat-sealed, welded seam, vacuum-sealed, or bubble-wrap type plastic bag to provide a controlled means and surface for stacking, standing, and interlocking when filled with various materials. This unique design and innovation can provide a competitive niche in the industry. This concept can be utilized in commercial storage as well as consumer storage. By attaching hose connectors, quick-connect stems, or valve spouts, this product can replace the "bag in the box" system used for packaging and dispensing liquids such as carbonated drinks, dairy beverages, and chemicals.

A primary object of the present invention is to provide a plastic bag having planar elements forming an integral part of said bag Another object of the present invention is to provide plastic bags wherein said planar elements have opposing mating forms therein.

Yet another object of the present invention is to provide a plastic bag having similar dimensioned rigid planar elements forming an integral part whereby said plastic bag can be freestanding.

Still yet another object of the present invention is to provide a plastic bag having planar elements that are dimensioned smaller than the dimensions of said plastic bag.

Another object of the present invention is to provide a plastic bag having formed opposing planar elements that are affixed to the exterior of the plastic bag.

Yet another object of the present invention is to provide a plastic bag having formed opposing planar elements that are affixed to the interior of the plastic bag.

Still yet another object of the present invention is to provide a plastic bag having formed opposing planar elements that are affixed between a first and second ply of the plastic bag.

Another object of the present invention is to provide a plastic bag having formed mating planar elements having ridges and troughs extending across the planar element terminating before the periphery thereof.

Yet another object of the present invention is to provide a plastic bag having formed opposing mating planar elements having ridges and troughs extending across said planar element terminating before the planar element periphery inhibiting lateral movement of a plurality of said stacked plastic bags.

Still yet another object of the present invention is to provide a plastic bag having a means for removably retaining the opposing mating planar elements that could include but isn't limited to sealable pockets or pouches.

Another object of the present invention is to provide a plastic bag having formed opposing mating planar elements that is simple and easy to use.

Yet another object of the present invention is to provide a plastic bag having planar rigid elements whereby said plastic bag can be used in similar fashion as a rigid container.

Another object of the present invention is to provide a plastic bag having planar rigid elements whereby said plastic bag can be used in similar fashion as a rigid container having one or more handles.

Yet another object of the present invention is to provide a plastic bag having formed opposing mating planar elements that is economical in cost to manufacture.

Additional objects of the present invention will appear as the description proceeds.

The present invention overcomes the shortcomings of the prior art by providing a stackable plastic bag having opposing mating rigid planar elements having impressed therein interlocking rounded grooves extending across said rigid element and terminating spaced away from the periphery edge of said rigid planar element.

Whereby placement of one plastic bag over another with the grooves in close proximity to one another would cause the grooves of the upper plastic bag to seat within the grooves of the lower plastic bag because the grooves are substantially rounded at each distal end.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
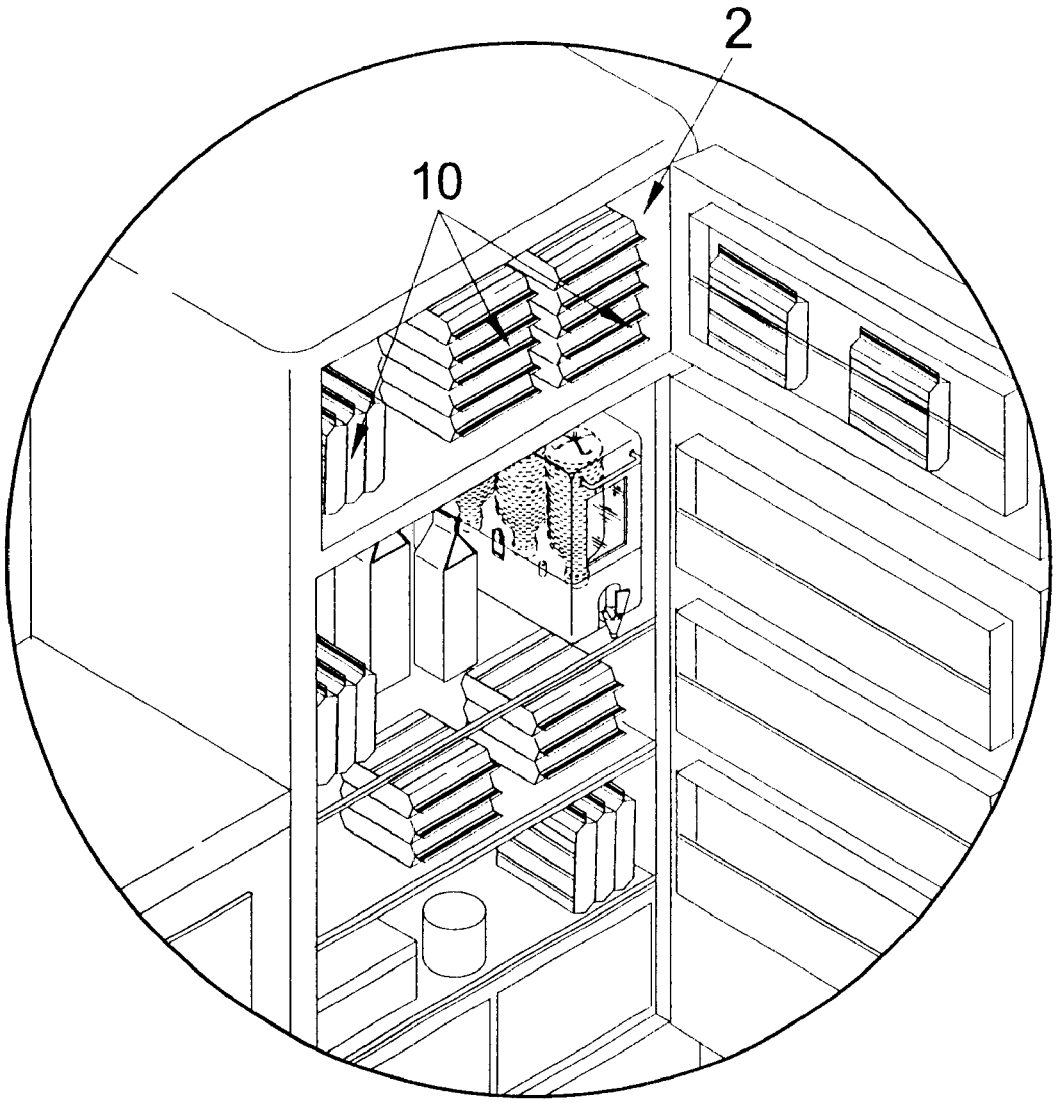
FIG. 1 is a perspective view of the present invention in use.

With regard to reference numerals used, the following numbering is used throughout the drawings.

10 present invention
12 plastic bag
14 upper rigid planar elements
15 lower rigid planar element
16 concave grooves
17 convex grooves
18 rounded end
20 periphery of planar element
22 outer bag surface
24 inner bag surface
26 lock means
28 contents
30 corrugated plate
32 circular indents
34 cross line indent
36 pocket
38 hose connector means
40 flowable product dispenser
42 hose
44 welded seam
46 sanitary storage bag
48 handles
50 fill spout
52 valve spout

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is a single or double ply thermoplastic bag of the present invention 10. By way of general explanation and as will be explained in detail hereinafter, the present invention 10 has a reclosable zip or slide lock, being heat sealed or vacuum sealed, or bubble wrapped with plastic molded plates of a flat or corrugated nature, consisting of convex and concave grooves or circles with male and female profiles that increase stability and provide a controlled means and surface for stacking and interlocking as the bags are filled and stacked or stood together. These molded plates are built into, bonded thereto, or otherwise disposed in the single or outer bag top and bottom surfaces. Both bag and the molded plates are a thermoplastic, thermoformed, or a resilient polymeric material suitable for both freezing and microwave heating.

Figure 2:
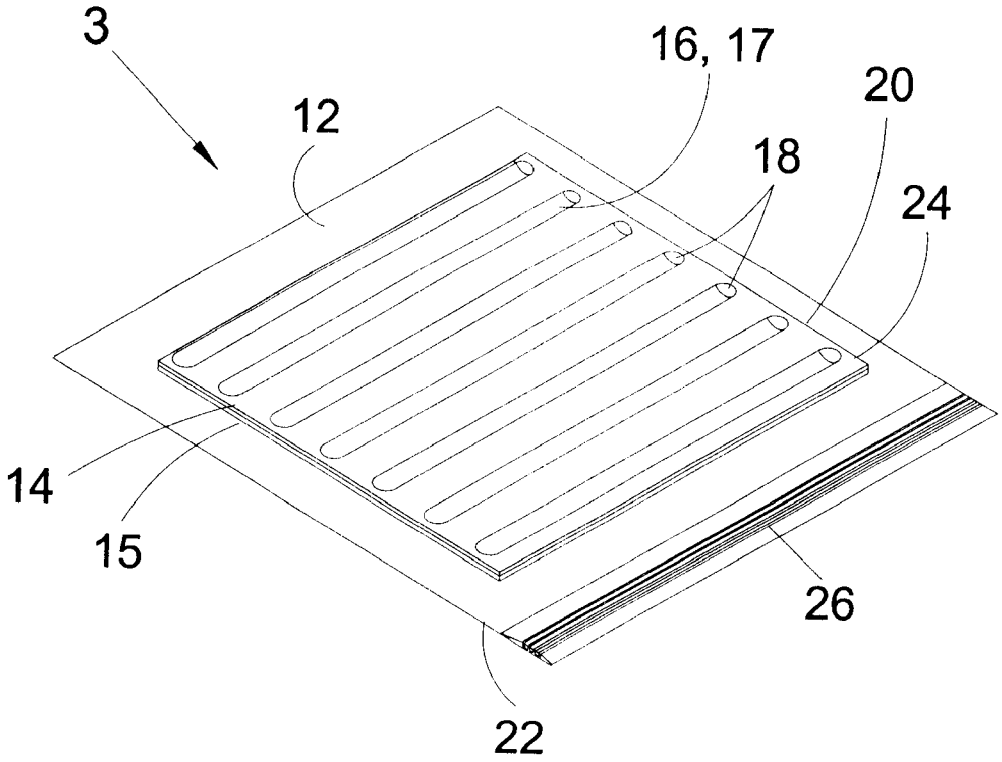
FIG. 2 is perspective view of the present invention empty and compact.

Turning to FIG. 2, shown therein depicts an empty plastic bag 12 having a first, upper 14 and a second, lower 15 rigid planar elements having spaced apart grooves 16, 17 with rounded distal ends 18 extending substantially across the planar element and terminating short of the planar element periphery 20. The rigid planar elements 14, 15 are smaller than the plastic bag 12 to permit filling of the plastic bag. The size and the shape of the bags 12 can vary depending upon the many uses of the bags. For example, a quart size zipper bag would be a different size and configuration than a blood transfusion bag for the medical field. Also shown are the outer surface 22 ply and the inner surface 24 ply which is contiguous to the first, upper rigid planar element 14 along with the bag lock means 26 of the bag 12.

Figure 3:
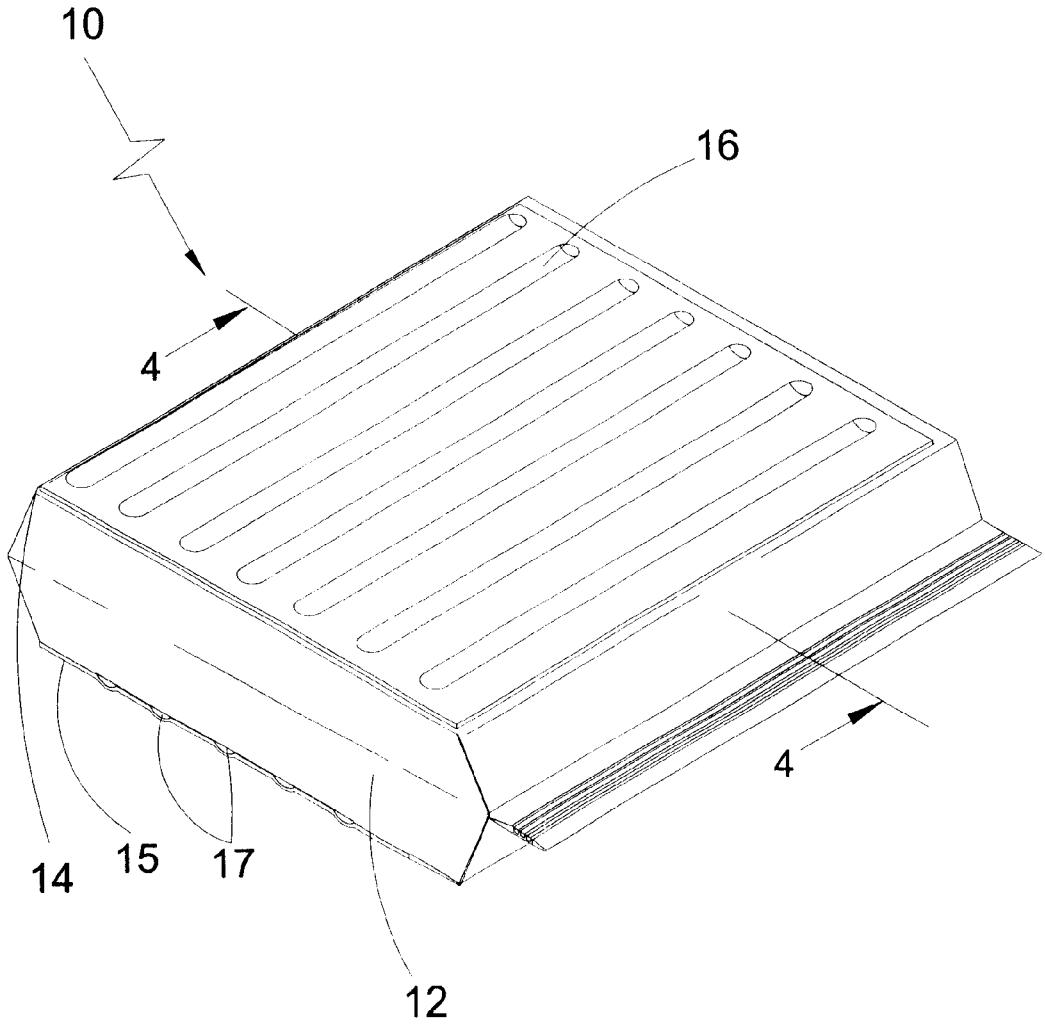
FIG. 3 is perspective view of the present invention full and controlled.

Turning to FIG. 3, shown therein is a perspective view of the present invention 10 in use and filled with a storable substance. When the bag 12 is full, the molded flat plastic plates 14, 15 provide controlled contents and a stackable surface allowing other bags to stack conveniently upon one another or side by side. The convex grooves 17 and concave grooves 16 allow the bags to interlock and increase the tensile strength thereof for improved stacking capabilities and content protection. The strength and rigidity of the planar elements 14, 15 are particularly helpful during the freezing process to help control swelling and bulging of the bags.

Figure 4:
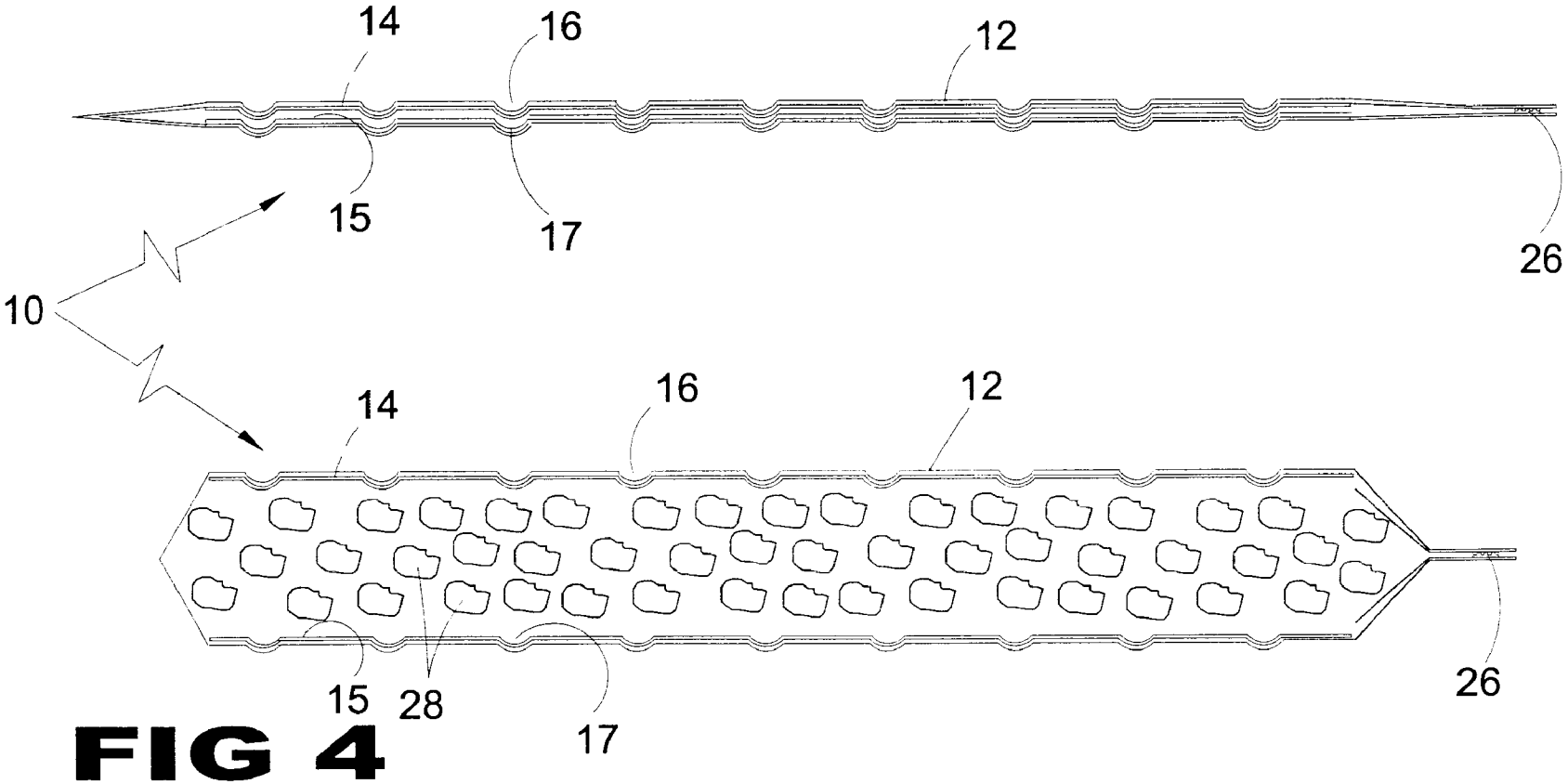
FIG. 4 is a cross sectional view of the present invention full and controlled and also when empty.

Turning to FIG. 4, shown therein is a cross-sectional side view of the present invention 10 showing both an empty and full embodiment with contents 28 with the molded flat plastic plates 14, 15 secured to the first and second inner wall of the plastic bag 12, with convex 17 and concave 16 round grooves that increase stability and provide means to stack additional bags by providing a substantially flat interlocking platform. Bag locking means 26 is also shown being a zip or side lock or the like bag lock.

Figure 5:
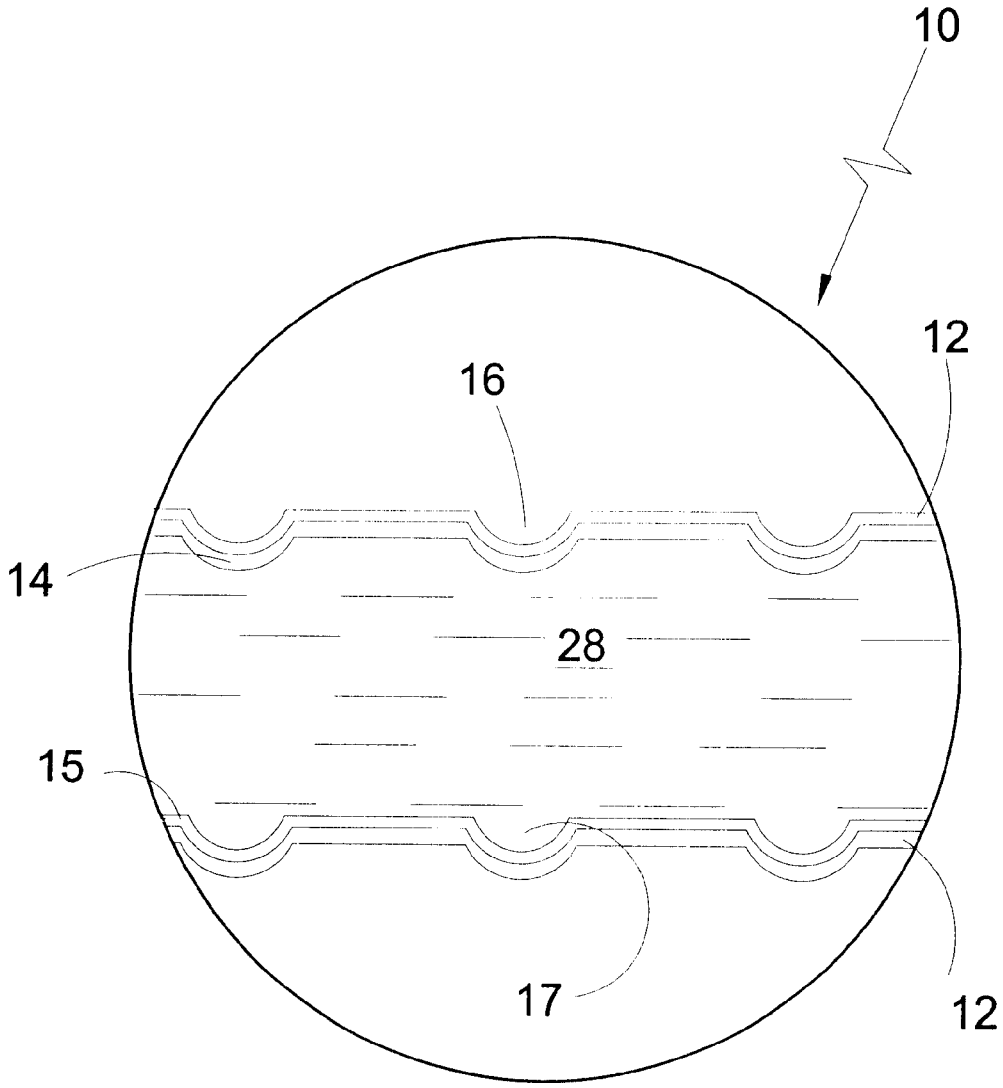
FIG. 5 is an enlarged view of the present invention.

Turning to FIG. 5, shown therein is an enlarged partial view of the present invention 10 depicting the plastic bag 12 secured to the rigid planar elements 14, 15 having rounded grooves 16, 17 that are held in a spaced away condition by a storable substance 28.

Figure 6:
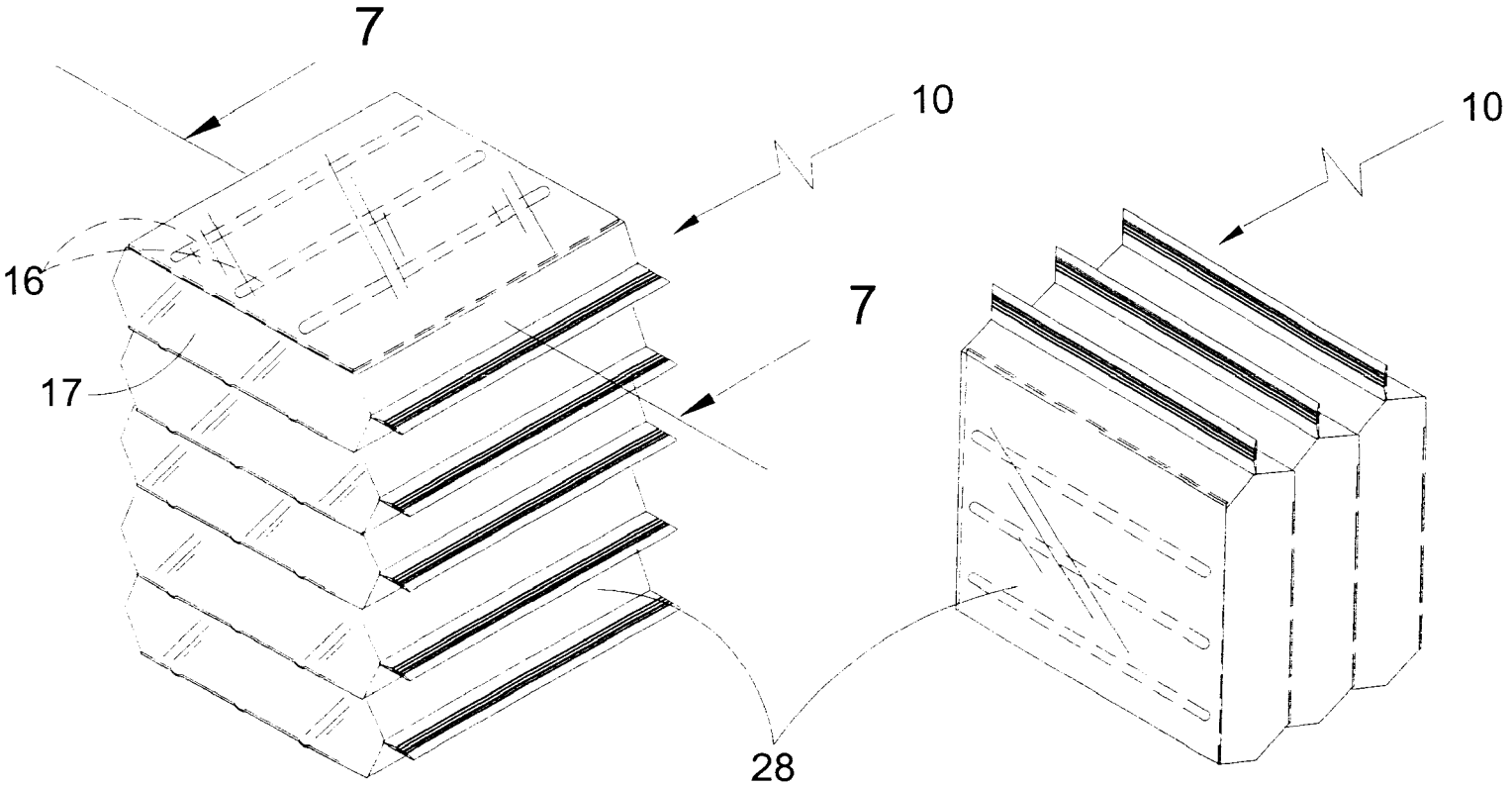
FIG. 6 is perspective view of the present invention when full, shown both standing and stacked.

Turning to FIG. 6, shown therein is the stackable food or content storage bag of the present invention 10 stacked horizontally or vertically in a freezer or refrigerator, pantry, storage rack etc., thus saving storage room and preventing freezer, pantry or storage blobs. Also shown are grooves 16, 17 and storage bag contents 28.

Figure 7:
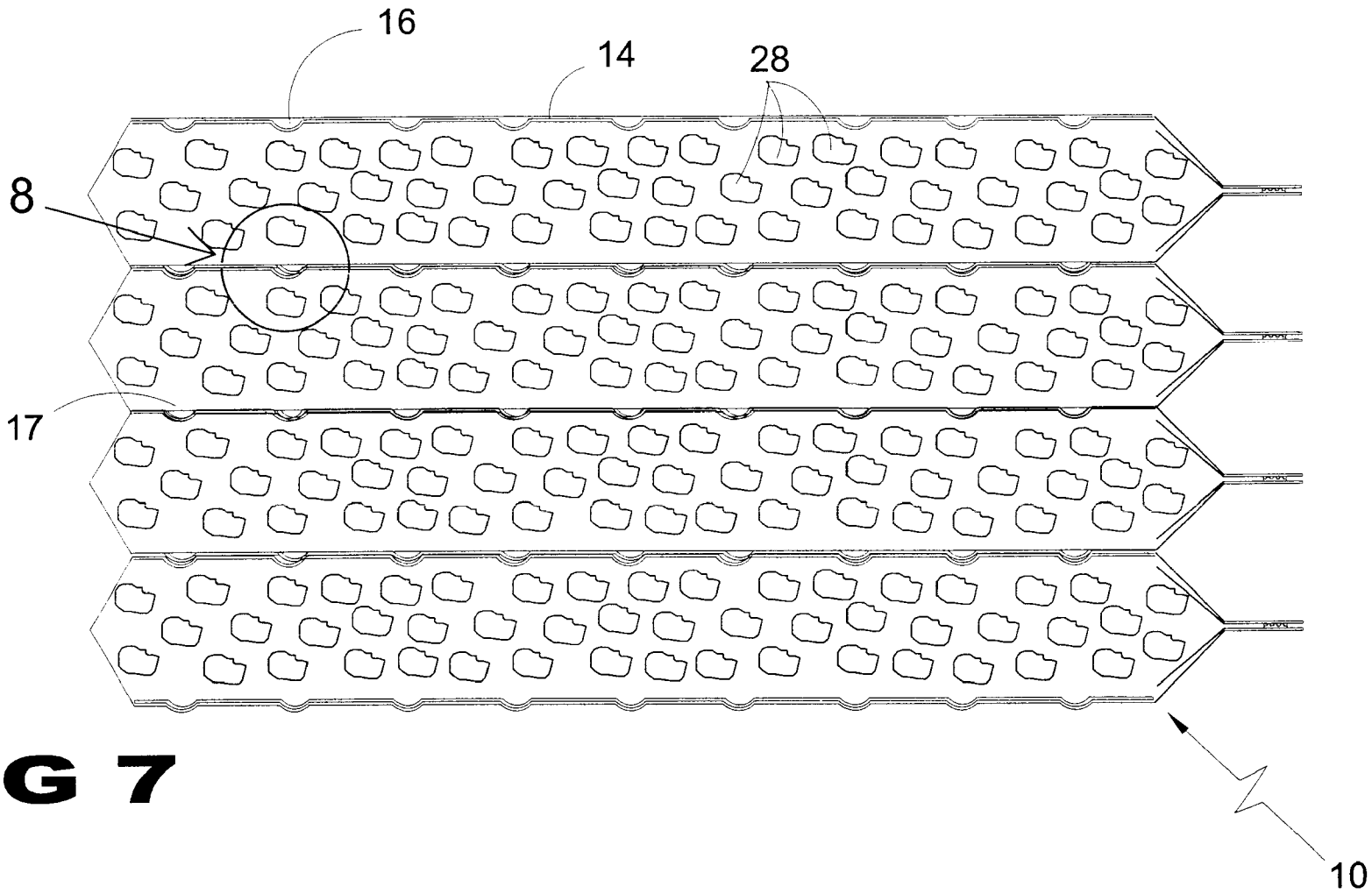
FIG. 7 is a cross sectional view of the present invention fully stacked and interlocked.

Turning to FIG. 7, shown therein is a cross-sectional side view of the present invention 10 showing several horizontal bags stacked one on top of another. The concave and convex 16, 17 help in securing each item stacked providing full space utilization. Plastic plate 14 and contents 28 are also shown.

Figure 8:
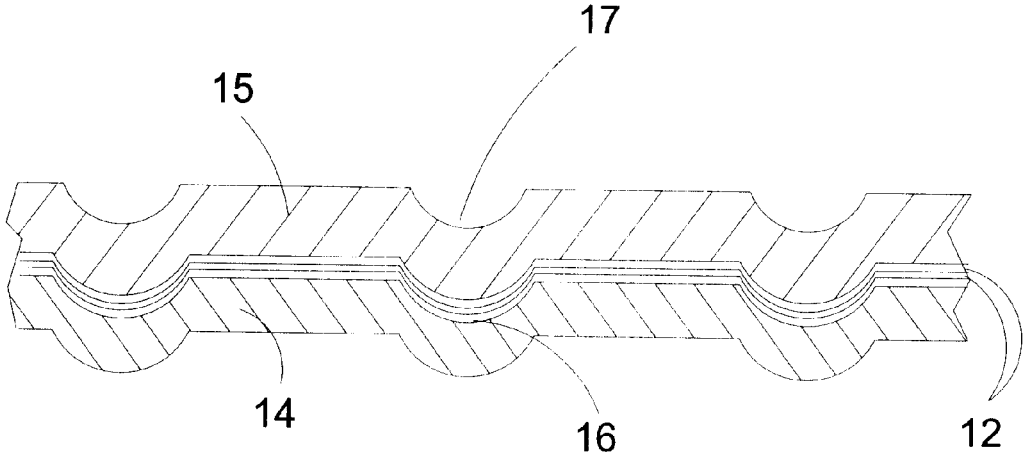
FIG. 8 is a detailed view of the substantially flat, molded plate.

Turning to FIG. 8, shown therein is the molded flat plastic plates 14, 15 secured to the inner wall of the plastic bag 12 with convex 17 and concave 16 round grooves that increase stability and provide a controlled means to stack and interlock additional bags.

Figure 9:
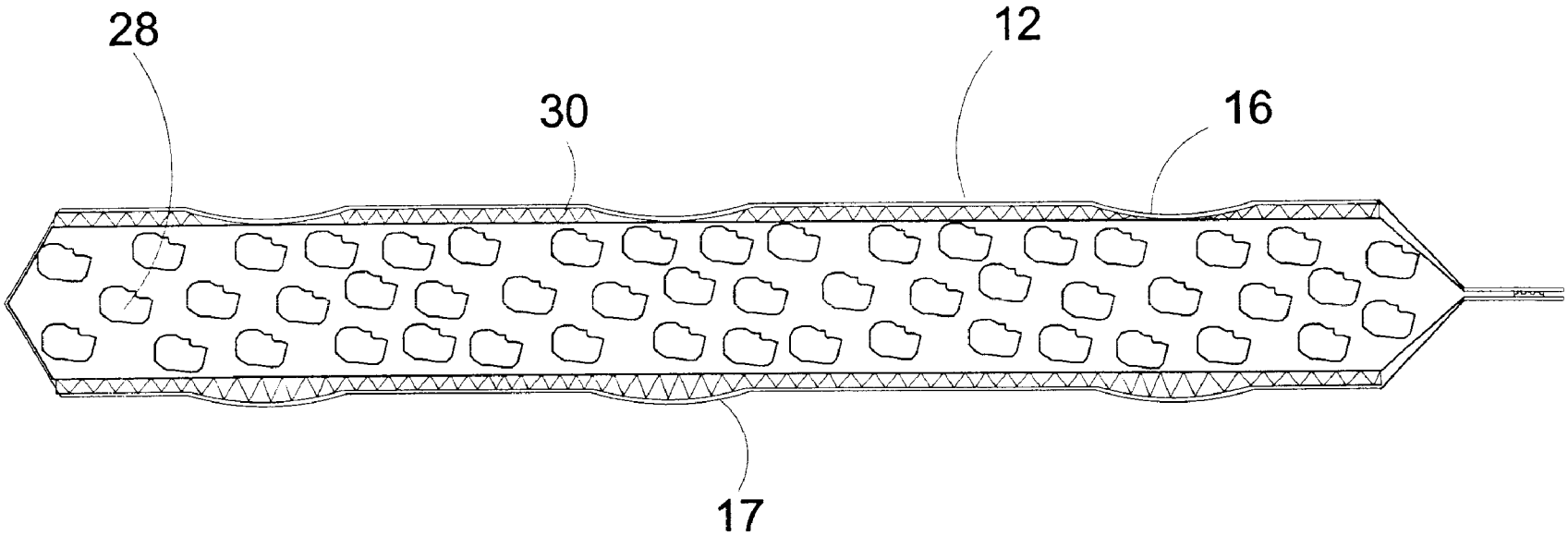
FIG. 9 is a sectional view of a corrugated rigid planar element.

Turning to FIG. 9, shown therein is the molded rigid planar element consisting of a molded corrugated construction 30 having upper and lower members having convex 17 and concave 16 round grooves similar to the previously disclosed embodiment. The rigid planar element is fixedly positioned to the interior wall of the plastic bag 12. Also shown are the contents 28.

Figure 10:
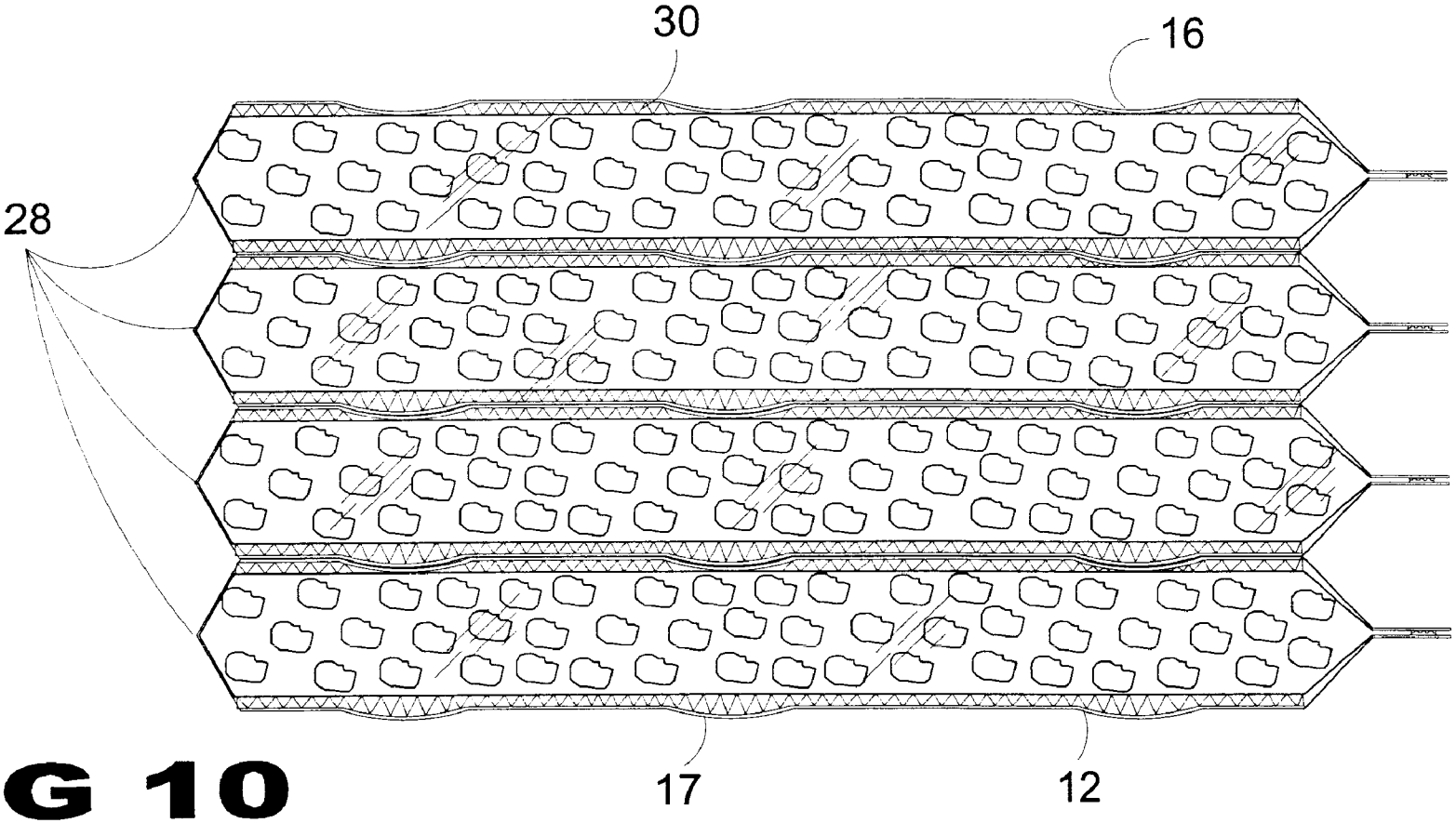
FIG. 10 is a side view of stacked plastic bags with corrugated elements.

Turning to FIG. 10, shown therein is a plurality of stacked plastic bags 12 having rigid planar corrugated elements 30 with rounded concave 16 and convex 17 grooves fixedly positioned to the interior walls of the plastic bags providing a method for stacking plastic bags using full utilization. Also shown are the contents 28.

Figure 11:
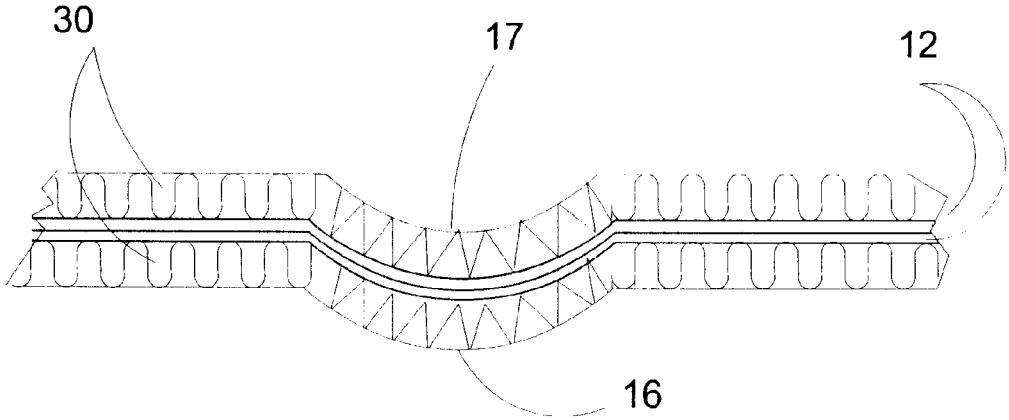
FIG. 11 is a detailed view of the corrugated molded plate.

Turning to FIG. 11, shown therein are the molded corrugated plastic plates 30 secured to the interior walls of the plastic bag 12 with convex 17 and concave 16 round grooves that provides a controlled means to stack and interlock additional bags for full space utilization.

Figure 12:
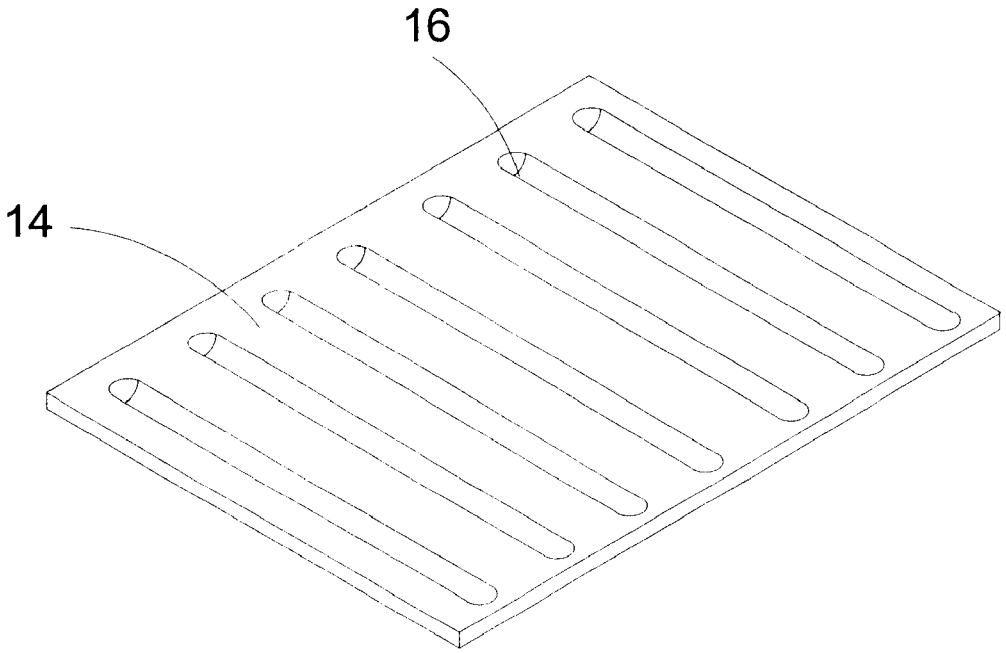
FIG. 12 is a detailed view of the rigid planar element of the present invention.

Turning to FIG. 12, shown therein is the molded flat plastic plate 14 with concave 16 grooves that provides a flat interlocking surface whereby additional bags can be stacked.

Figure 13:
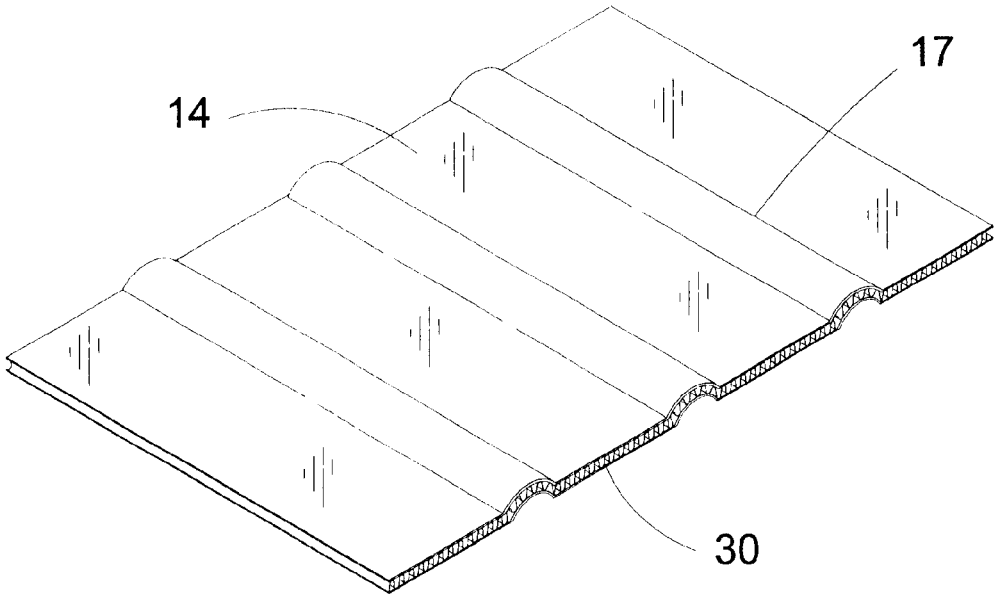
FIG. 13 is a detailed view of an alternate plate device of the present invention.

Turning to FIG. 13, shown therein is the molded corrugated 30 plate 14 with convex 17 grooves that provide stability and an interlocking surface for stacking and are fixedly positioned to the interior walls of the plastic bag.

Figure 14:
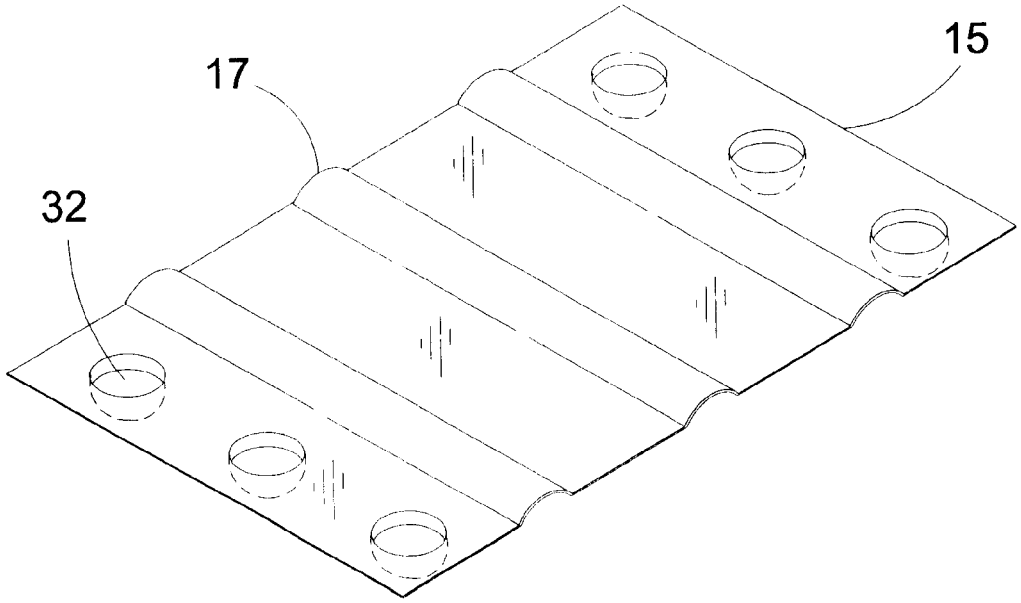
FIG. 14 is a detailed view of an alternate plate device of the present invention.

Turning to FIG. 14, shown therein is the molded plastic plate 15 with bulbous interlocking concave and convex circular indents 32 and grooves 17 that provide stability and surface for stacking and are molded to the inner walls (top and bottom) of the zip lock bag.

Figure 15:
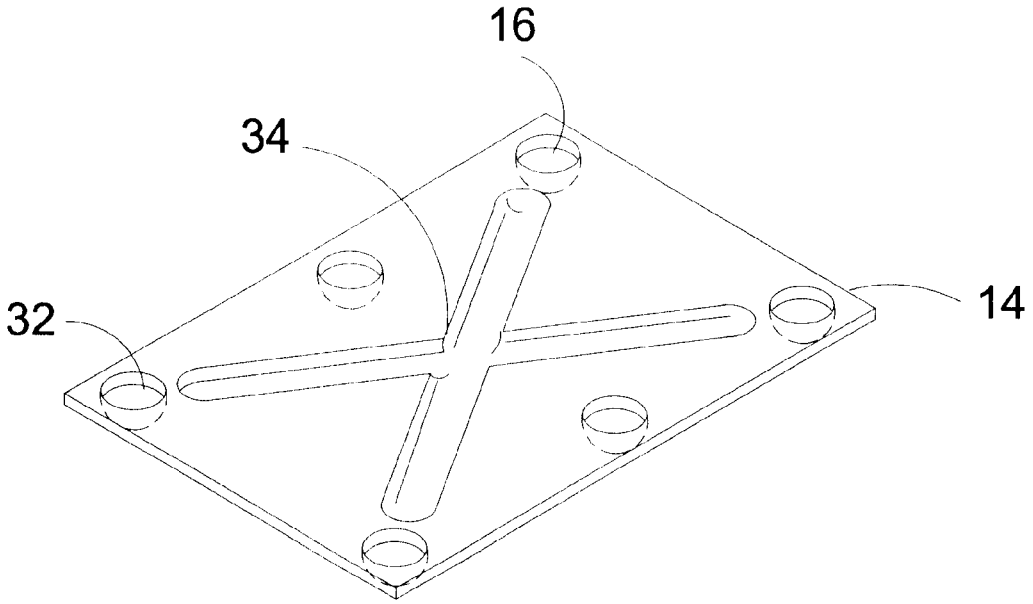
FIG. 15 is a detailed view of an alternate plate device of the present invention.

Turning to FIG. 15, shown therein is the molded plastic plate 14 with concave 16 grooves and circles 22 that provide stability and surface for stacking and are molded to the inner walls (top and bottom) of the zip lock bag. Also shown is a cross line indent 34 similar to the previously disclosed embodiments.

Figure 16:
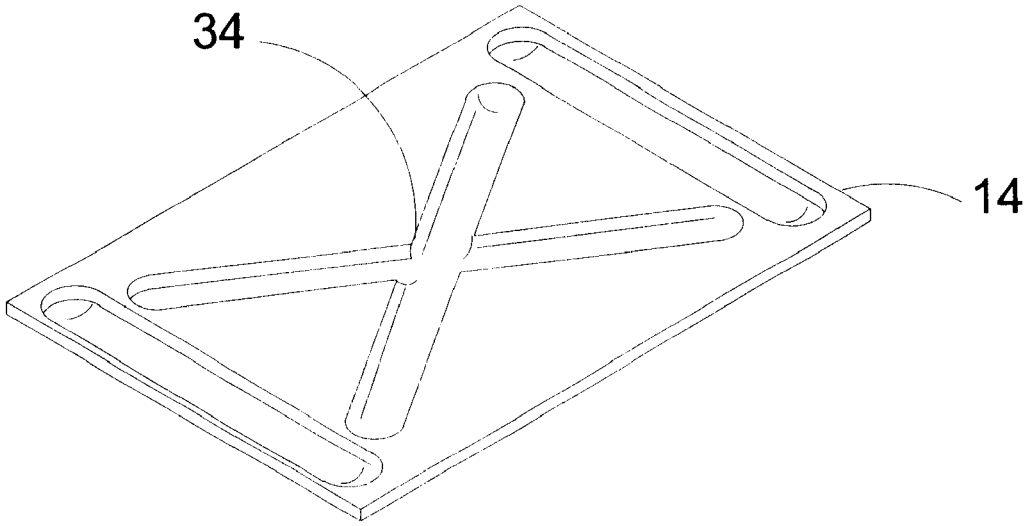
FIG. 16 is a detailed view of an alternate plate device of the present invention.

Turning to FIG. 16, shown therein is the molded plastic plate 14 with concave and convex grooves and circles that provide stability and surface for stacking and are molded to the inner walls (top and bottom) of the zip lock bag.

Figure 17:
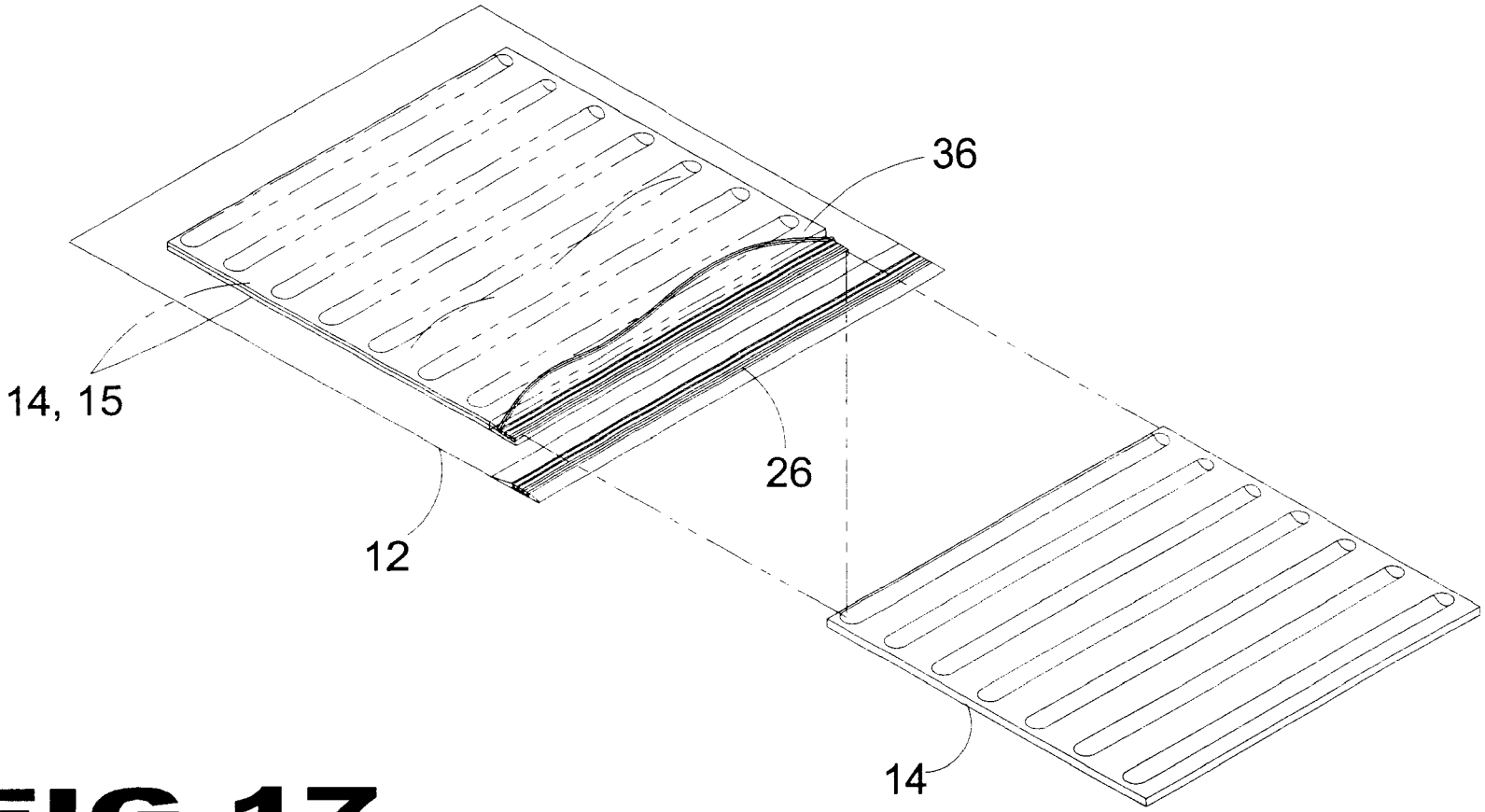
FIG. 17 is a perspective of the present invention showing an additional design option with the planar elements being replaceably removable from the bag.

Turning to FIG. 17, shown therein is a perspective of the present invention showing and additional design option with the planar elements 14, 15 being replaceably removable from the bag 12. The plate design and the concept are the same as previously disclosed. The bag 12 has pockets or 36 on the top and bottom sides of the bag 12 to allow the plates 14, 15 to be removed and replaced as needed so they can be recycled and reused. Also shown is bag lock means 26.

Figure 18:
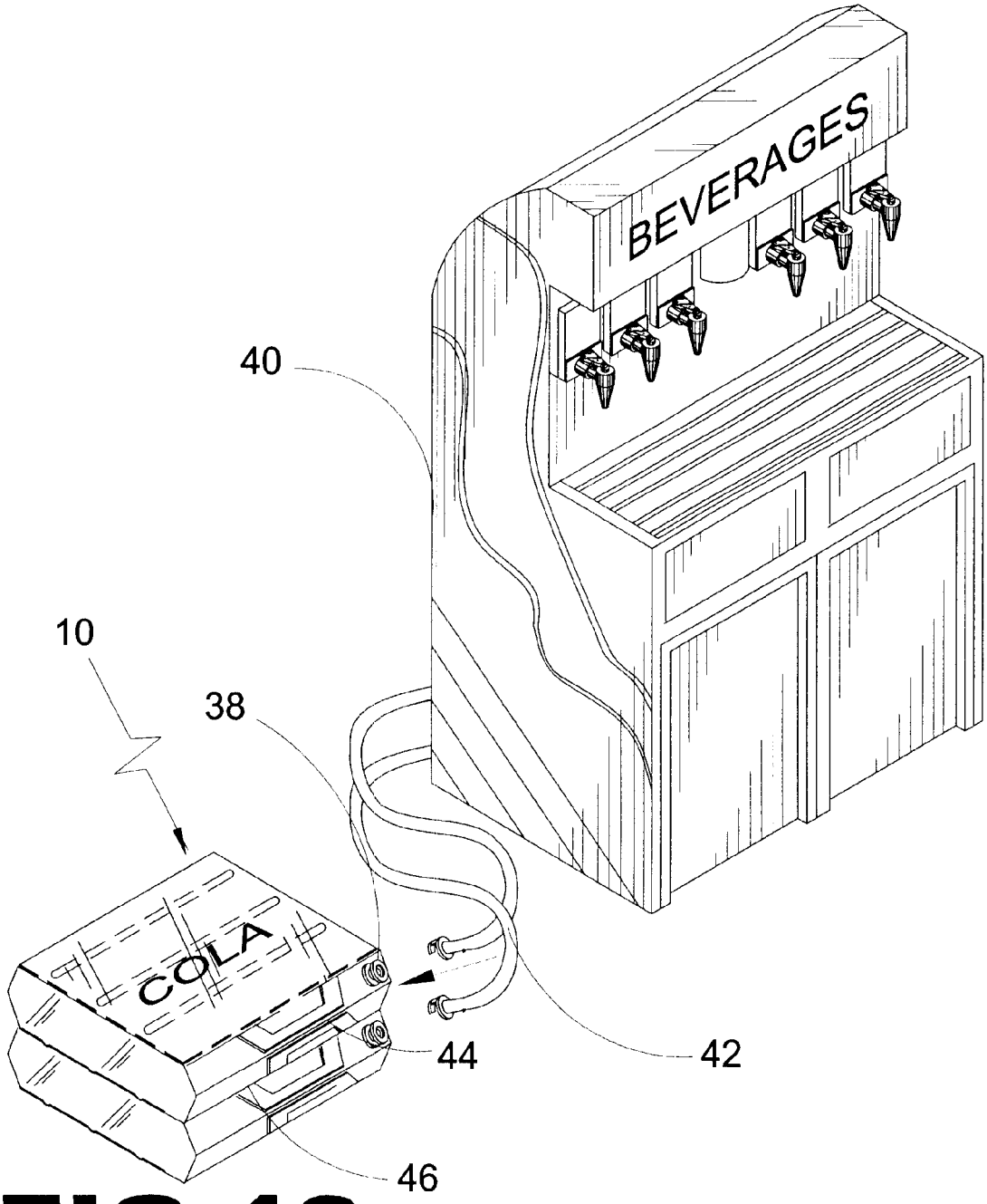
FIG. 18 is a perspective view of the present invention.

Turning to FIG. 18, shown therein is a perspective view of the present invention 10. Shown is the present invention being a sanitary dispensing container for liquids or flowable products having a hose connector means, e.g., a quick connect stem or valve, 38 that is being used to connect the present invention to a standard or conventional soda or flowable product dispenser or machine 40 using hose 42. This embodiment uses a welded seam 44 to provide a sanitary storage bag 46.

Figure 19:
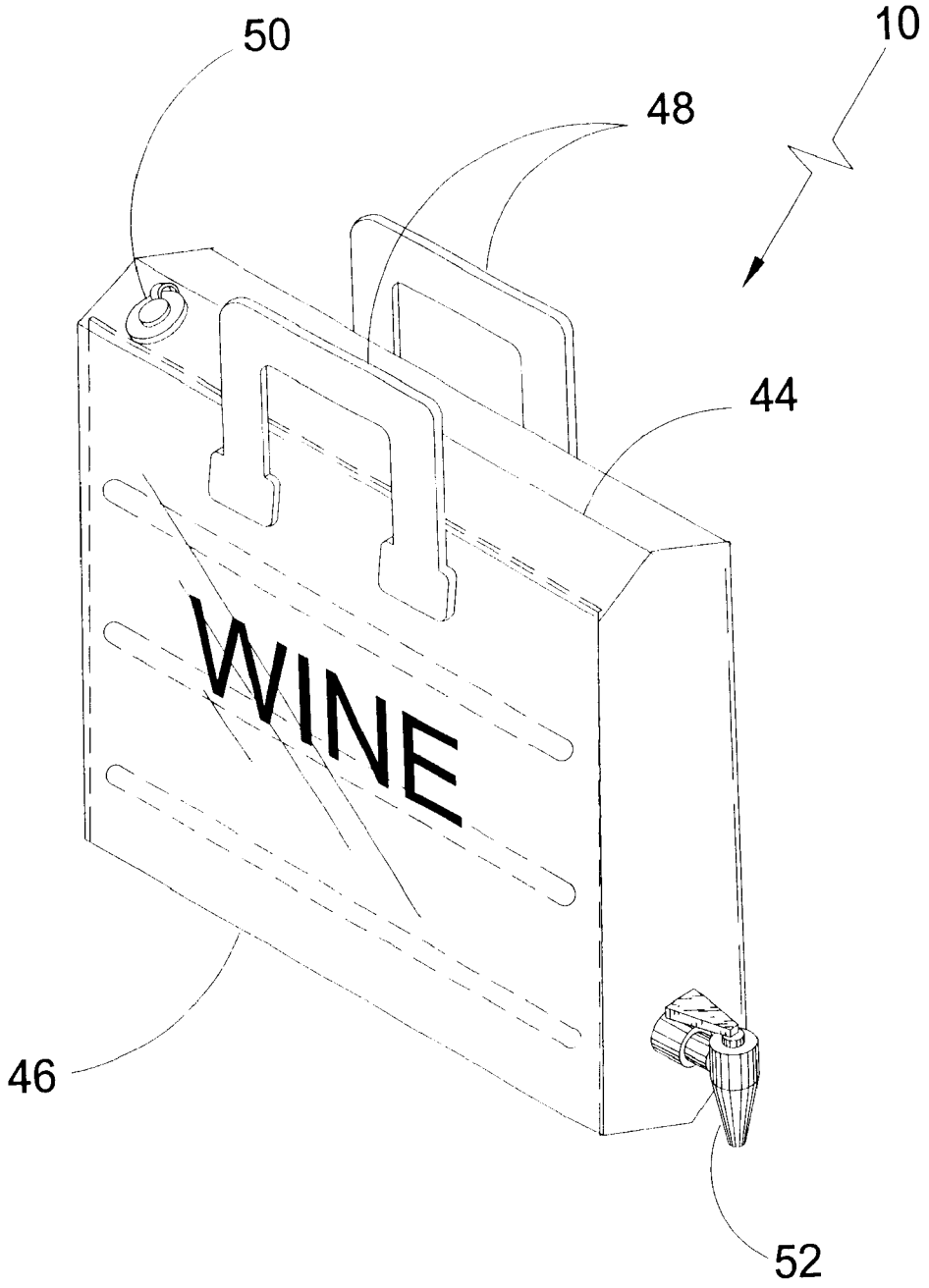
FIG. 19 is a perspective view of the present invention.

Turning to FIG. 19, shown therein is a perspective view of the present invention 10. Shown is the present invention having a plurality of handles 48 attached to the upper portion of the storage bag 46 with a fill spout 50 for filling the bag and a valve spout 52 for dispensing the fluid contained therein. Also shown is the welded seam 44.

What is claimed to be new and desired to be protected by Letters Patent is set forth in the appended claims.

I claim:

1. In a plastic bag having a first and a second wall and a bag lock, the improvement comprising:

a) a first rigid planar member disposed on a first wall internal of the bag, said first rigid planar member being complementarily shaped as the bag, said rigid member being smaller than the bag for the bag to receive said rigid member therein;

b) a second rigid planar member disposed on a second wall internal of the bag, said second rigid planar member being complementarily shaped as the bag, said rigid member being smaller than the bag for the bag to receive said rigid member therein;

c) a plurality of first convex grooves disposed in said second rigid planar member, said grooves being parallel to each other; and, d) a plurality of second concave grooves disposed in said first rigid planar member, said grooves being parallel to each other, said concave grooves for receiving said convex grooves of said second rigid planar member when a first bag is stacked on a second bag.

2. The apparatus of claim 1, wherein said concave and convex grooves have rounded ends for mating to each other.

3. The apparatus of claim 2, wherein said rounded ends of said grooves terminate short of the edge of said first and second rigid planar member.

4. The apparatus of claim 3, wherein said first and second rigid planar members are secured to the first and second walls of the bag.

5. The apparatus of claim 4, wherein said first and second rigid planar members further comprise corrugated construction.

6. The apparatus of claim 5, wherein said first and second rigid planar members further comprise molded construction.

7. The apparatus of claim 6, wherein said second rigid planar member further comprises a plurality of convex, circular indentions disposed therein.

8. The apparatus of claim 7, wherein said first rigid planar member further comprises a plurality of concave, circular indentions disposed therein for receiving said convex circular indentions.

9. The apparatus of claim 8, wherein said second rigid planar member further comprises a plurality of convex, cross line indentions disposed therein.

10. The apparatus of claim 9, wherein said first rigid planar member further comprises a plurality of concave, cross line indentions disposed therein for receiving said convex cross line indentions.

11. The apparatus of claim 10, further comprising a first and a second pouch disposed on the exterior of the first and second wall of the bag for receiving said first and second rigid planar member.

12. The apparatus of claim 11, wherein said first and second pouch further comprise a sealing means whereby said first and second rigid planar member can be inserted and removed from said first and second pouch.

13. The apparatus of claim 12, further comprising a welded seam on the bag for enclosing the contents thereof, a handle for carrying the bag, an inlet for adding the contents to the bag, and an outlet for removing the contents from the bag.

14. In a flowable product dispenser having an outlet for the flowable product and an inlet for the flowable product, the improvement comprising:

a) a plastic bag having a first and a second wall;

b) a first rigid planar member disposed on said first wall internal of the bag, said first rigid planar member being complementarily shaped as the bag, said rigid member being smaller than the bag for the bag to receive said rigid member therein;

c) a second rigid planar member disposed on said second wall internal of the bag, said second rigid planar member being complementarily shaped as the bag, said rigid member being smaller than the bag for the bag to receive said rigid member therein;

d) a plurality of first convex grooves disposed in said second rigid planar member, said grooves being parallel to each other;

e) a plurality of second concave grooves disposed in said first rigid planar member, said grooves being parallel to each other, said concave grooves for receiving said convex grooves of said second rigid planar member when a first bag is stacked on a second bag;

f) a welded seam lock disposed on said bag to enclose said bag; and, g) a means for an outlet disposed on said bag whereby the contents of the bag can be transferred to the inlet of the flowable product dispenser.

15. The apparatus of claim 14, wherein said bag further comprises a handle for carrying the bag about.

* * * * *